US007928365B2

(12) United States Patent
Oonishi et al.

(10) Patent No.: US 7,928,365 B2
(45) Date of Patent: Apr. 19, 2011

(54) METHOD AND APPARATUS FOR MASS SPECTROMETRY

(75) Inventors: Fujio Oonishi, Yokohama (JP); Kenichi Shinbo, Yokohama (JP); Ritsuro Orihashi, Tokyo (JP); Yasushi Terui, Tsuchiura (JP); Tsukasa Shishika, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 204 days.

(21) Appl. No.: 11/319,611

(22) Filed: Dec. 29, 2005

(65) Prior Publication Data

US 2006/0248942 A1 Nov. 9, 2006

(30) Foreign Application Priority Data

Feb. 25, 2005 (JP) ..... 2005-050102

(51) Int. Cl.
*H01J 49/00* (2006.01)

(52) U.S. Cl. ..... 250/287; 250/281; 73/23.37

(58) Field of Classification Search ..... 250/287
See application file for complete search history.

(56) References Cited

U.S. PATENT DOCUMENTS 4,583,183 A * 4/1986 Winiecki et al. ..... 702/31
5,058,146 A * 10/1991 Dupoy ..... 377/39
5,777,326 A * 7/1998 Rockwood et al. ..... 250/287
6,393,367 B1 * 5/2002 Tang et al. ..... 702/19
2003/0010907 A1 * 1/2003 Hayek et al. ..... 250/281
2003/0020644 A1 * 1/2003 Yeap et al. ..... 341/144
2003/0173514 A1 * 9/2003 Syage et al. ..... 250/287

FOREIGN PATENT DOCUMENTS

JP 09-184823 A 7/1997
JP 11-287807 10/1999
JP 2002-245963 8/2002
JP 2002-260577 9/2002
JP 2005-166627 6/2005

OTHER PUBLICATIONS

Japanese Office Action dated Mar. 9, 2010, issued in corresponding Japanese Patent Application No. 2005-050102.

* cited by examiner

*Primary Examiner* — Phillip A Johnston
(74) *Attorney, Agent, or Firm* — Antonelli, Terry, Stout & Kraus, LLP.

(57) ABSTRACT

For the achievement of data transfer time reduction, removal of noise data, and analytical efficiency improvement in an ADC data processing function of a time-of-flight mass spectrometer, the mass spectrometer comprises a data acquisition circuit including: an A/D converter; a signal intensity addition memory that stores data of ion signals such as a time range and the number of measurements and performs an addition process; a voltage value frequency addition memory that performs an addition process of frequencies of voltage values of the predetermined time range and the number of measurements and stores addition results; a threshold level computation circuit that computes a predetermined threshold level from the results in the memory; a compression memory that extracts only data exceeding the threshold level from the data in the signal intensity addition memory; and a counter that controls a measurement time for data acquisition and the operation of each circuit.

6 Claims, 9 Drawing Sheets

| ADDRESS | TIME | VOLTAGE VALUE |
|---|---|---|
| 0 | 0ns | 0.2V |
| 1 | 3ns | 0.01V |
| 2 | 4ns | 0.04V |
| 3 | | |
| 4 | | |
| ⋮ | ⋮ | ⋮ |
| | | |

| ADDRESS (TIME) | VOLTAGE VALUE |
|---|---|
| 0(0s) | 0.2V |
| 1(1ns) | 0.005V |
| 2(2ns) | −0.1V |
| 3(3ns) | 0.01V |
| 4(4ns) | 0.04V |
| ⋮ | ⋮ |
| | |

METHOD AND APPARATUS FOR MASS SPECTROMETRY

CROSS-REFERENCE TO RELATED APPLICATION

The present application claims priority from Japanese Patent Application No. JP 2005-50102 filed on Feb. 25, 2005, the content of which is hereby incorporated by reference into this application.

TECHNICAL FIELD OF THE INVENTION

The present invention relates to a mass spectrometry technology. More particularly, it relates to a technology effectively applied to data processing technologies for mass spectrometry using an A/D converter in a Time-of-Flight Mass Spectrometer (TOF-MS).

BACKGROUND OF THE INVENTION

FIG. 8 illustrates outlines of a TOF-MS using a data acquisition circuit studied by the inventors as a premise of the present invention.

The TOF-MS is an apparatus in which a sample is ionized and accelerated in a space and a time of flight in the space, which depends on its mass, is measured, thereby analyzing components contained in the sample. The sample is ionized in an interface 1, and is then reached to a Time-of-Flight (TOF) region 2.

The ion fed to the TOF region 2 is accelerated at a timing of a pulse signal 11*a* generated from a pulser 11. The accelerated ion flies through the course represented by an arrow in the drawing inside the TOF region 2, and then reaches (collides with) a detector (micro channel plate) 21, thereby generating a detection signal 2*a*. A gain adjuster 4 connected to a stage previous to the data acquisition circuit 5 adjusts the amplitude of the detection signal 2*a*, and a detection signal 4*a* after the amplitude adjustment is inputted to the data acquisition circuit 5.

In the data acquisition circuit 5, the time of flight of the ion is repeatedly measured with this detection signal 4*a*, and acquired addition data (measurement results) 5*b* is outputted to a user interface unit 62 via a CPU 61.

Here, systems of acquiring time-of-flight data in the data acquisition circuit 5 include a Time to Digital Converter (TDC) system and an Analog to Digital Converter (ADC) system. In the apparatus for quantitative analysis of each component contained in the sample, the ADC system is often used.

The amplitudes of the detection signal 2*a* are different in accordance with the number of ions reaching (colliding with) the detector (Micro Channel Plate) 21. In the TDC system, a time and the number of detections are acquired when the data exceeds a certain level (threshold level) regardless of the magnitude of the amplitude of the detection signal 2*a*. Meanwhile, in the ADC system, the amplitude data is acquired at predetermined time intervals.

The gain adjuster 4 connected to the stage previous to the data acquisition circuit 5 adjusts the amplitude of the detection signal 2*a*, and then the detection signal 4*a* after the amplitude adjustment is inputted to an A/D converter 51 of the data acquisition circuit 5. The detection signal 4*a* after the A/D converter 51 at the timing of a reference converts the amplitude adjustment clock 50*a* generated by a clock generator 50 into digital data 51*a* representing a voltage value, and the digital data 51*a* is stored in a signal intensity addition memory 53. FIG. 9 shows an example thereof. Subsequently, after a measurement is repeatedly performed up to the number of times set by a user, the addition data is transferred to the CPU 61, and data analysis is performed in the CPU 61. However, since the next measurement cannot start during data transfer, all of the data transfer time corresponds to a measurement suspension time.

FIG. 10 illustrates one example of a procedure in the above-described ADC system. In this example, in a process 1, a measurement and an addition computation are performed 100 times. In a process 2, all pieces of data stored in the process 1 are transferred to the CPU 61. Also, it is assumed that each measurement time is 1 ms, a sampling speed of the A/D converter 51 is 1 Gsps, a bus speed at the time of CPU transfer is 25 MHz/point, and an address region of the signal intensity addition memory 53 is 1 mega (M) points. In this example, a time required for the process 1 is 100 ms (=1 ms×100 times), and a time for the process 2 is 40 ms (=1 M points/25 MHz).

Here, since the next measurement (process 1) cannot start during the data transfer, all of the time of the process 2 corresponds to a measurement suspension time. In this example, approximately 40% of the measurement time is a measurement suspension time, which leads to a degradation in measurement efficiency.

Also, in the above-described ADC system, since it is required that n-bit sampling data from the A/D converter 51 representing the amplitude of the detection signal is obtained on the order of M points and further the obtained data is subjected to an addition process, the entire amount of data is increased in comparison with the TDC system. For the solution of this problem, for example, Japanese Patent Application Laid-open Publication No. 11-287807 discloses the technology of removing unnecessary sampling data, and United States Patent Application Publication No. 2003-0173514 discloses a data compression process such as the noise reduction by means of threshold levels.

In FIG. 11, as a technology associated with United States Patent Application Publication No. 2003-0173514, a data compression (noise reduction) technology studied by the inventors as a premise of the present invention is depicted.

Sampling data from an A/D converter includes not only a peak spectrum but also a lot of unnecessary data such as a noise level, for example. Therefore, in this data compression technology, a threshold level is set and the sampling data equal to or lower than the threshold level is cut off without being written in the memory, and only data exceeding the threshold level is transferred.

There are a variety of schemes for processing the data at the points which are cut off because the data is equal to or lower than the threshold level, which include an offset operation system in which data equal to or lower than a predetermined level (in the drawing, the threshold level) is offset uniformly to the threshold level as shown in FIG. 11A and a threshold level operation system in which all pieces of data equal to or lower than a predetermined level (threshold level) are treated as 0 level as shown in FIG. 11B.

In these data compression processes, when data compression is performed to the addition data, since it is required that all pieces of measurement data are transferred to the CPU and then a compression process is performed by the CPU, a problem of increasing a measurement suspension time (data transfer time) occurs.

Moreover, in the technologies discussed in the above-mentioned Japanese Patent Application Laid-Open Publication No. 11-287807 and United States Patent Application Publication No. 2003-0173514, processor processing or hardware multiplexing is performed. Therefore, a problem that the process becomes complicated and the cost is increased occurs.

SUMMARY OF THE INVENTION

Accordingly, the present invention is to solve the above-described problems, and an object thereof is to provide a mass spectrometry technology capable of achieving a reduction in data transfer time by extracting and transferring only the data exceeding a threshold level, in an ADC data processing function of a time-of-flight mass spectrometer. Note that, in the present invention, simultaneously with a reduction in data transfer time, removal of noise data can be achieved.

Furthermore, another object of the present invention is to provide a mass spectrometry technology capable of achieving an improvement in analytical efficiency by extracting only the stored data required for the analysis.

The above and other objects and novel characteristics of the present invention will be apparent from the description of this specification and the accompanying drawings.

The typical ones of the inventions disclosed in this application will be briefly described as follows.

In the present invention, in an ADC data processing function of a time-of-flight mass spectrometer, as means for extracting only a signal required for the analysis in a short time, a voltage value frequency addition memory circuit for adding frequencies of voltage values is provided, and a predetermined process is performed to determine a threshold level based on the noise distribution represented by the stored contents of the memory circuit. Then, only the data exceeding this threshold level is extracted and transferred. By doing so, a reduction in data transfer time can be achieved.

Also, in the present invention, the user of the apparatus refers to the contents of the above-described voltage value frequency addition memory circuit and a signal intensity addition memory circuit, and based on the reference result, a threshold level for discriminating between a noise value and a signal value is set, and then, only the stored data required for analysis is extracted. By doing so, an analytical efficiency can be improved.

More specifically, the present invention is applied to a time-of-flight mass spectrometer having a data processing function, in which an ionized sample is accelerated and allowed to fly and a detection signal obtained by detecting the flying ion is processed, and to a mass spectrometry method in this mass spectrometer, and the present invention has the following features.

(1) A time-of-flight mass spectrometer comprises: an A/D converter that samples a detection signal; a first memory circuit that stores sampling data from the A/D converter while performing an addition process of the sampling data; a second memory circuit that performs an addition process of frequencies of voltage values from the A/D converter and stores an addition result; a computing unit that performs a predetermined process based on the result of addition process in the second memory circuit to calculate a threshold level; and a third memory circuit that extracts only the data exceeding the threshold level, which is an output signal from the computing unit, from an addition process result in the first memory circuit, and stores the extracted data.

(2) In another aspect of the time-of-flight mass spectrometer described in (1), the computing unit performs a predetermined process based on the addition process result in the second memory circuit to calculate a threshold level and an offset value, and a third memory circuit extracts only the data obtained by performing an adding/subtracting process equivalent to the offset value to the data exceeding the threshold level, which is the output signal from the computing unit, from the addition process result in the first memory circuit, and stores the extracted data.

(3) In another aspect of the time-of-flight mass spectrometer described in (1), a register is provided instead of the computing unit, and the register calculates and sets a threshold level by performing a predetermined process after the apparatus user reads the addition result in the second memory circuit. Also, the third memory circuit extracts only the data exceeding the threshold level set in the register, and stores the extracted data.

(4) In another aspect of the time-of-flight mass spectrometer described in (1), a register group is provided instead of the computing unit, and the register group calculates and set a threshold level and an offset value by performing a predetermined process after the apparatus user reads the addition process result in the second memory circuit. Also, the third memory circuit extracts only the data obtained by performing an adding/subtracting process equivalent to the offset value to the data exceeding the threshold level set in the register group, and stores the extracted data.

The effects obtained by typical aspects of the present invention will be briefly described below.

According to the present invention, in an ADC data processing function, a voltage value frequency addition memory circuit for determining a threshold level and a data compression memory circuit for extracting only a signal exceeding the threshold level are provided. Therefore, data required for analysis can be easily compressed and a data transfer time can be reduced. As a result, a measurement suspension time of the apparatus can be reduced.

Also, according to the present invention, the determination and the setting of a threshold level at the time of data compression can be made by the apparatus user performing an arbitrary computation based on the time-based voltage value addition results and the voltage value frequency addition results. Therefore, the user can set an arbitrary discrimination value of a noise value and a signal value, and the efficiency of the analytical operation can be improved.

These and other objects, features and advantages of the invention will be apparent from the following more particular description of preferred embodiments of the invention, as illustrated in the accompanying drawings.

BRIEF DESCRIPTIONS OF THE DRAWINGS

DESCRIPTIONS OF THE PREFERRED EMBODIMENTS

Concept of the Invention

According to the present invention, in an ADC data processing technology for mass spectrometry in which time-of-flight data is measured and acquired, a memory circuit for performing the time-based voltage value addition process for the sampling data of each measurement and a voltage frequency addition memory circuit for performing the addition of the frequencies of voltage values during the measurement simultaneously with the above-mentioned addition process are provided. After all measurements are finished, a predetermined process is performed to determine a threshold level based on the voltage value frequency data. Further, a memory circuit for data compression for extracting only a signal exceeding the threshold level is provided, and only the compressed data is transferred to a CPU. Accordingly, a reduction in data transfer time is achieved.

Also, in the data compression process according to the present invention, after the measurements using the memory circuit for performing time-based voltage value addition process and the voltage value frequency addition memory circuit are finished, only the voltage value frequency addition results are transferred to the CPU, and an apparatus user then performs a predetermined process based on those addition results to determine a threshold level, thereby generating compressed data by the memory circuit for data compression.

Hereinafter, embodiments of the present invention will be described in detail with reference to the accompanying drawings. Note that components having the same function are denoted by the same reference symbols throughout the drawings for describing the embodiment, and the repetitive description thereof will be omitted.

First Embodiment

Figure 1:
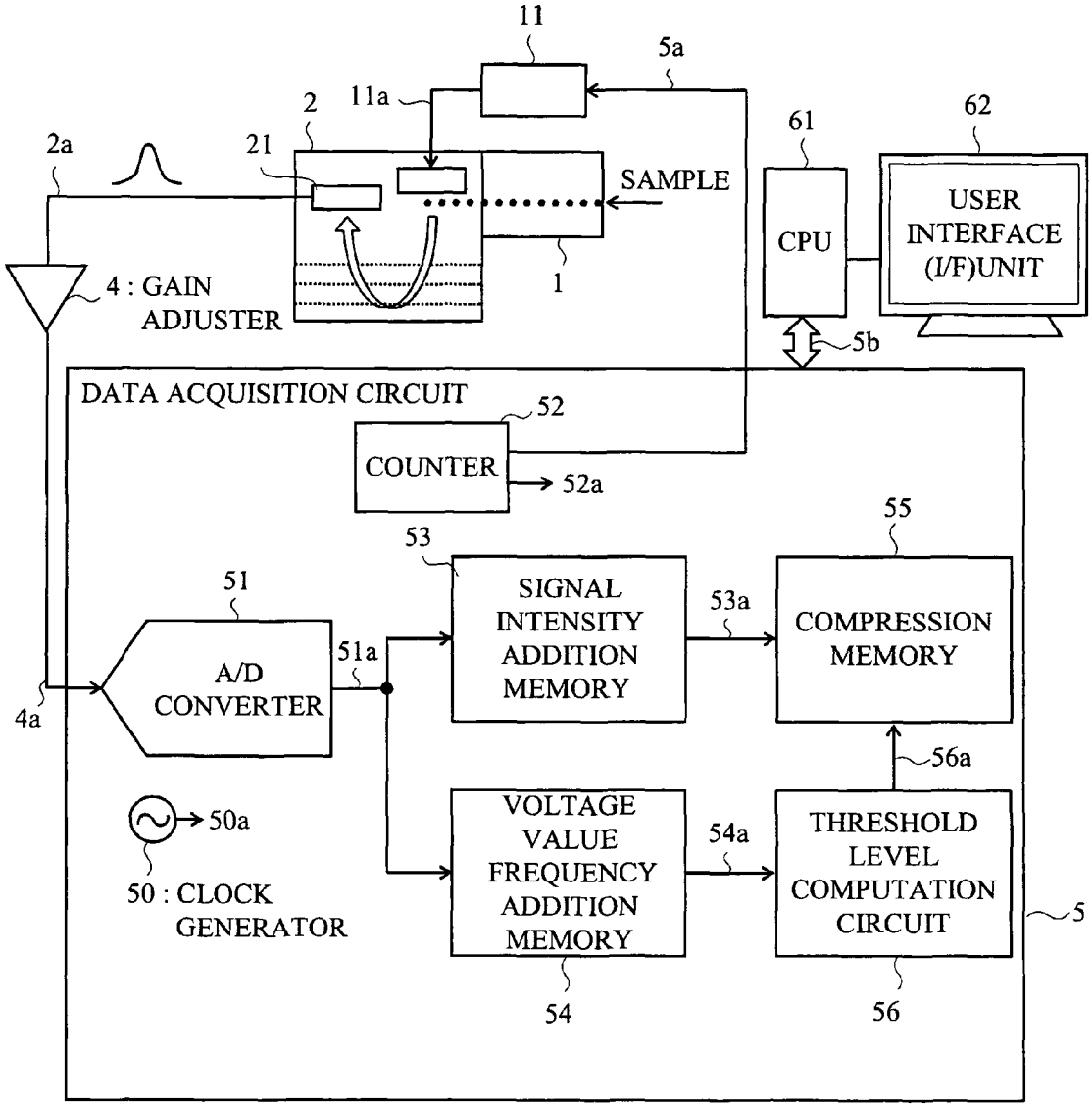
FIG. 1 is a block diagram showing an example of the configuration of a time-of-flight mass spectrometer having a data processing function according to a first embodiment of the present invention.

FIG. 1 is a drawing showing an example of the configuration of a time-of-flight mass spectrometer having a data processing function according to a first embodiment of the present invention.

The mass spectrometer according to this embodiment typically includes a sample interface 1, a pulser 11, a time-of-flight (TOF) region 2 provided with a detector (micro channel plate) 21, a gain adjuster 4, a data acquisition circuit 5, a CPU 61, and a user interface (I/F) unit 62.

The data acquisition circuit 5 includes a clock generator 50 for generating a reference clock 50*a*, an A/D converter 51 for sampling a detection signal 4*a*, a counter 52 for generating a measurement start signal 5*a* and a control signal 52*a* for data storage, data computation, and data extraction, a signal intensity addition memory (first memory circuit) 53 for storing sampling data 51*a* while performing an addition process, a voltage value frequency addition memory (second memory circuit) 54 for storing frequencies of voltage values in the sampling data 51*a* while performing an addition process, a compression memory (third memory circuit) 55 for extracting only the data exceeding a threshold level 56*a* from addition process results 53*a* of the sampling data 51*a* and storing the extracted data, and a threshold level computation circuit (computing unit) 56 for performing a predetermined process based on voltage value frequency addition results 54*a* to calculate the threshold level 56*a*.

Figure 8:
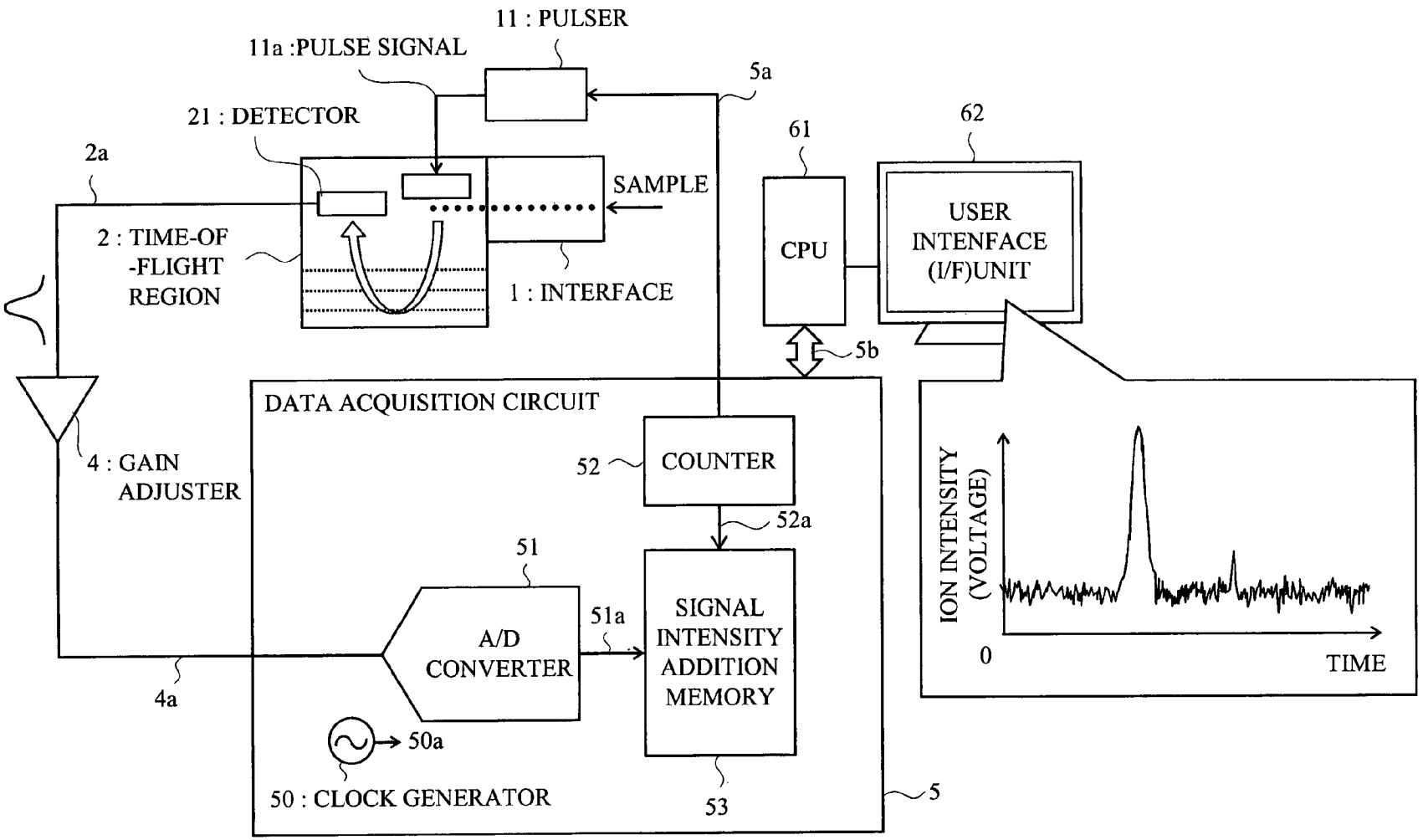
FIG. 8 is a block diagram showing an example of the configuration of a time-of-flight mass spectrometer studied as a premise of the present invention.

In this mass spectrometer, the interface 1, the pulser 11, the TOF region 2, and the gain adjuster 4 have the same functions as those of the respective components depicted in FIG. 8, and therefore, the description thereof is omitted here. Also, in the data acquisition circuit 5, the clock generator 50, the A/D converter 51, the counter 52, and the signal intensity addition memory 53 have the same functions as those of the respective circuits depicted in FIG. 8, and therefore, the description thereof is omitted here. In the following, operation examples of each of newly-added circuits, that is, the voltage value frequency addition memory 54, the compression memory 55, and the threshold level computation circuit 56 will be described.

In the operation of the voltage value frequency addition memory 54, with using a digitized voltage value itself outputted from the A/D converter 51 as an address of the memory, how many times that voltage value is outputted from the A/D converter 51 is counted. For example, when a sampling speed of the A/D converter 51 is 1 GHz, a sampling time is 1 μsec, and a voltage input to the A/D converter 51 is 0 V, 1 k digitized voltage values indicating 0 V are outputted from the A/D converter 51. In the voltage value frequency addition memory 54, 1 k count values remain at an address indicating 0 V.

Figure 2A:
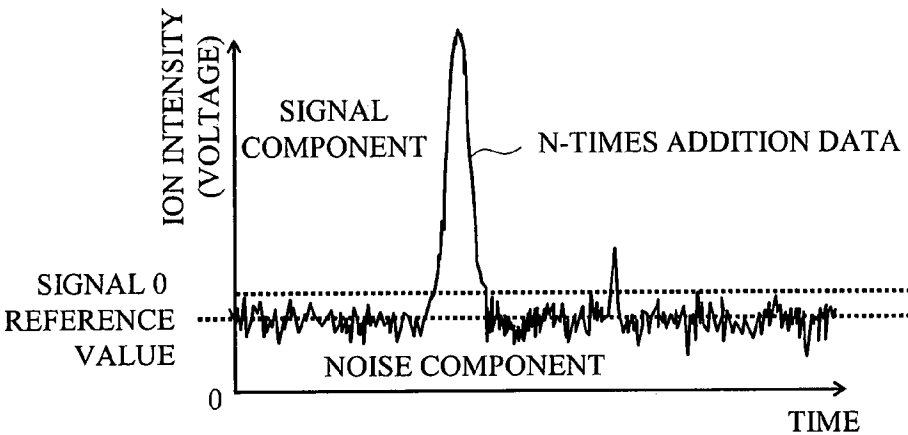
FIG. 2A is a drawing showing an example of storage in a signal intensity addition memory in a data processing method according to the first embodiment of the present invention.
Figure 2B:
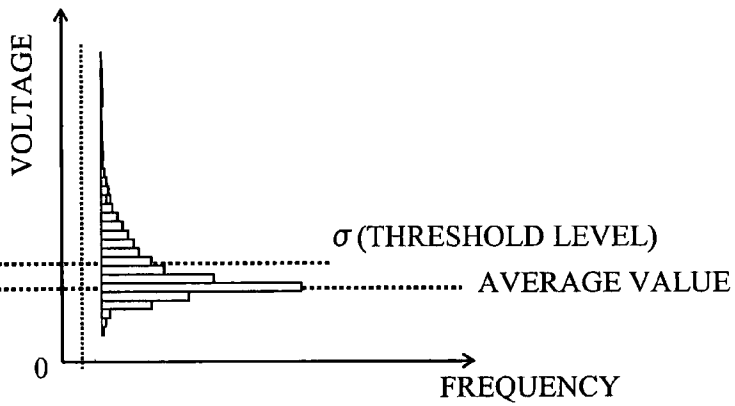
FIG. 2B is a drawing showing an example of storage in a voltage value frequency addition memory in the data processing method according to the first embodiment of the present invention.

Next, the operation of the threshold level computation circuit 56 will be described with reference to FIG. 2A and FIG. 2B. FIG. 2A and FIG. 2B depict a data processing method, wherein FIG. 2A shows an example of storage in the signal intensity addition memory 53, and FIG. 2B shows an example of storage in the voltage value frequency addition memory 54. In FIG. 2A, the horizontal axis represents a time, which indicates a range of storage, and the vertical axis represents an average voltage value as a result of n-times addition. Also, in FIG. 2B, the vertical axis represents a voltage value, and the horizontal axis represents a frequency of that voltage values. In these drawings, the average value represents an average value of all pieces of data added in the voltage value frequency addition memory 54, and σ represents a standard deviation value calculated from a curve obtained through normal distribution approximation of histogram results of the voltage value frequency addition memory 54.

Figures 3, 4:
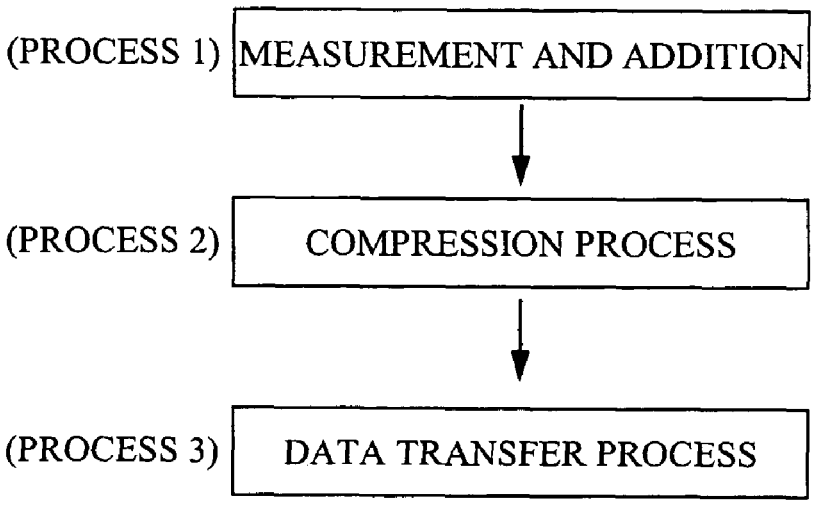
FIG. 3 is a drawing showing an example of extraction of time data and voltage value data in the data processing method according to the first embodiment of the present invention.
FIG. 4 is a flow chart showing an example of the procedure of the data processing method according to the first embodiment of the present invention.

Here, the output 56*a* from the threshold level computation circuit 56 is σ and is used as a threshold level of the compression memory 55 described next. Next, in the compression memory 55, an addition is performed n times, and then, after performing a σ-value computation in the threshold level computation circuit 56, time data having an ion intensity (voltage value) exceeding the σ value and voltage value data indicating the ion intensity are extracted from the signal intensity addition memory 53. An example of such data is shown in FIG. 3. This example shows the case where the σ value is 0.01 V, and voltage value data exceeding 0.01 V and its time data are extracted as a pair. Only the data exceeding the σ value is extracted and transferred to the CPU 61.

Next, FIG. 4 shows an example of the procedure according to this embodiment. In this case, under the same conditions as those of the conventional example described in FIG. 10, a processing time is estimated. In this example, the number of data exceeding the threshold level after measurement is assumed to be one-tenth of the number of measurement points.

A process 1 is the case where the number of measurements is 100, a measurement range is 1 ms, a sampling speed of the A/D converter 51 is 1 Gsps, and the signal intensity addition memory 53 has an address of 1 M points, and the time required for the process 1 is 100 ms. Also, in the process 1, simultaneously with the completion of the 100-th measurement, an average value and a σ value of the voltage values outputted from the A/D converter 51 are calculated by the voltage value frequency addition memory 54 and the threshold level computation circuit 56, and therefore, the average value and the σ value are calculated from the results obtained from up to the 99-th measurement. Therefore, upon the completion of the 100-th measurement, the average value and the σ value can be obtained. Next, in a process 2, voltage values exceeding the σ value (threshold level) are extracted, and this extraction is performed for the time equal to the time of a process of reading the signal intensity addition memory 53 once, which corresponds to one measurement time, that is, 1 ms.

Next, in a process of data transfer to the CPU 61, since the number of points is assumed to be one-tenth of 1 M points as described above, the number of points is 100 k points. Here, since the extracted data includes time data and voltage value data, two data transfers are required and it is assumed that two-point transfer is performed. Therefore, the data transfer rate to the CPU 61 is 8 ms (100 K points×2 data/25 MHz).

Figures 9, 10:
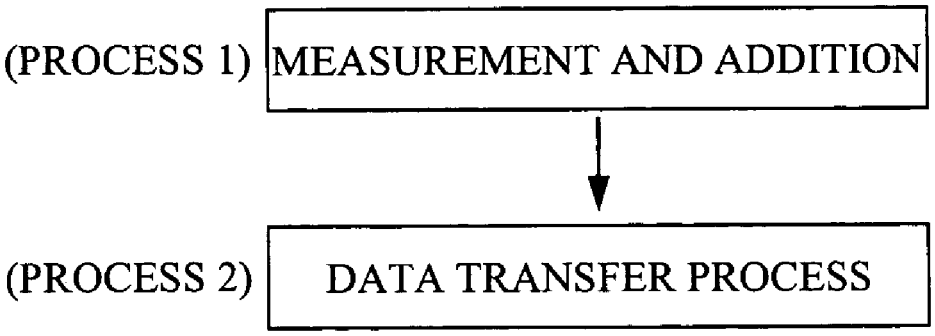
FIG. 9 is a drawing showing an example of extraction of voltage value data in a data processing method studied as a premise of the present invention.
FIG. 10 is a flow chart showing an example of the procedure of the data processing method studied as a premise of the present invention.
Figure 11A:
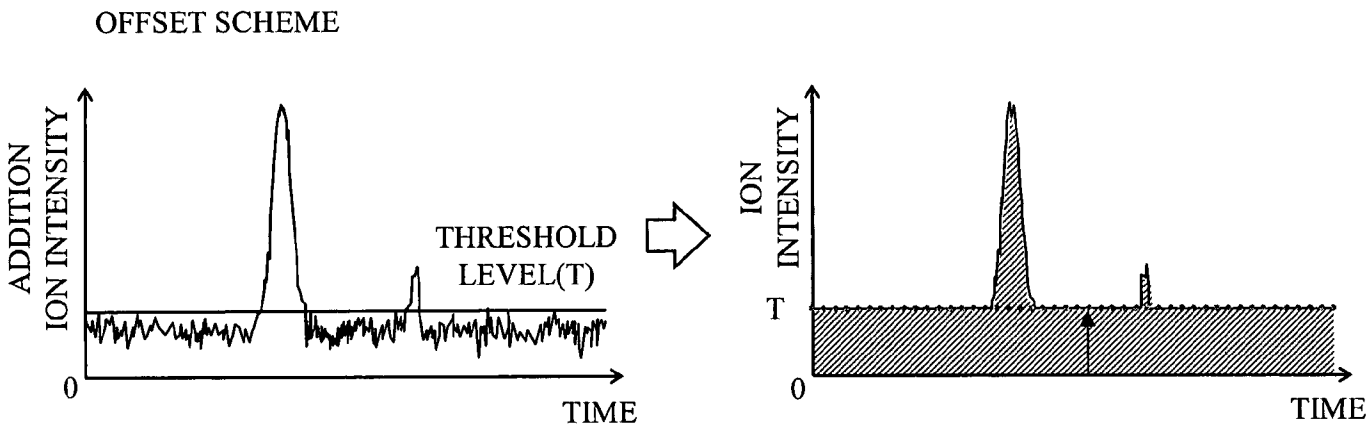
FIG. 11A is a drawing showing an offset operation system in a data compression method studied as a premise of the present invention.
Figure 11B:
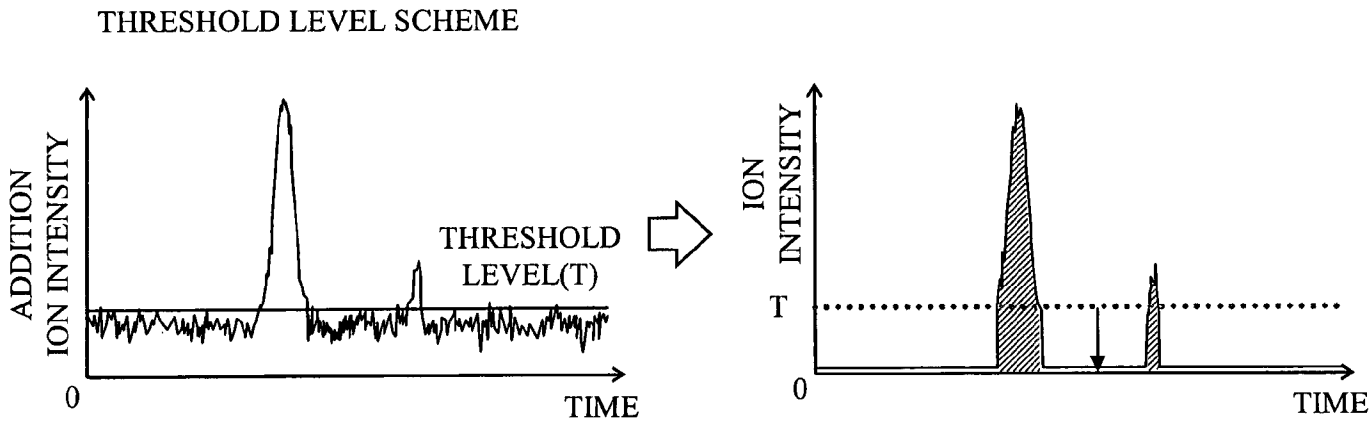
FIG. 11B is a drawing showing a threshold level operation system in the data compression method studied as a premise of the present invention.

As described above, in contrast to the conventional example described with reference to FIG. 10 in which the time required for data transfer after measurement is 40 ms, even a total time required for the compression process and the data transfer process is 9 ms in this embodiment. Accordingly, the data processing time can be reduced.

Note that, in this embodiment, the threshold level computation circuit 56 calculates a standard deviation value (σ). However, the threshold level computation circuit 56 can perform not only this σ-value computation but also a desired computation defined by apparatus specifications or the like.

Furthermore, in this embodiment, the threshold level 56*a*, which is the output from the threshold level computation circuit 56, is inputted to the compression memory 55. Alternatively, the threshold level 56*a* can also be inputted to the signal intensity addition memory 53. In this case, when a measurement is performed, a threshold level measurement is performed in advance by using only the voltage value frequency addition memory 54, and then, signals exceeding the threshold level is stored by using the signal intensity addition memory 53. Furthermore, upon the completion of the measurement using the signal intensity addition memory 53, data can be extracted by the compression memory 55 by using the same threshold level, and then, the extracted data can be transferred to the CPU 61.

Second Embodiment

Figure 5:
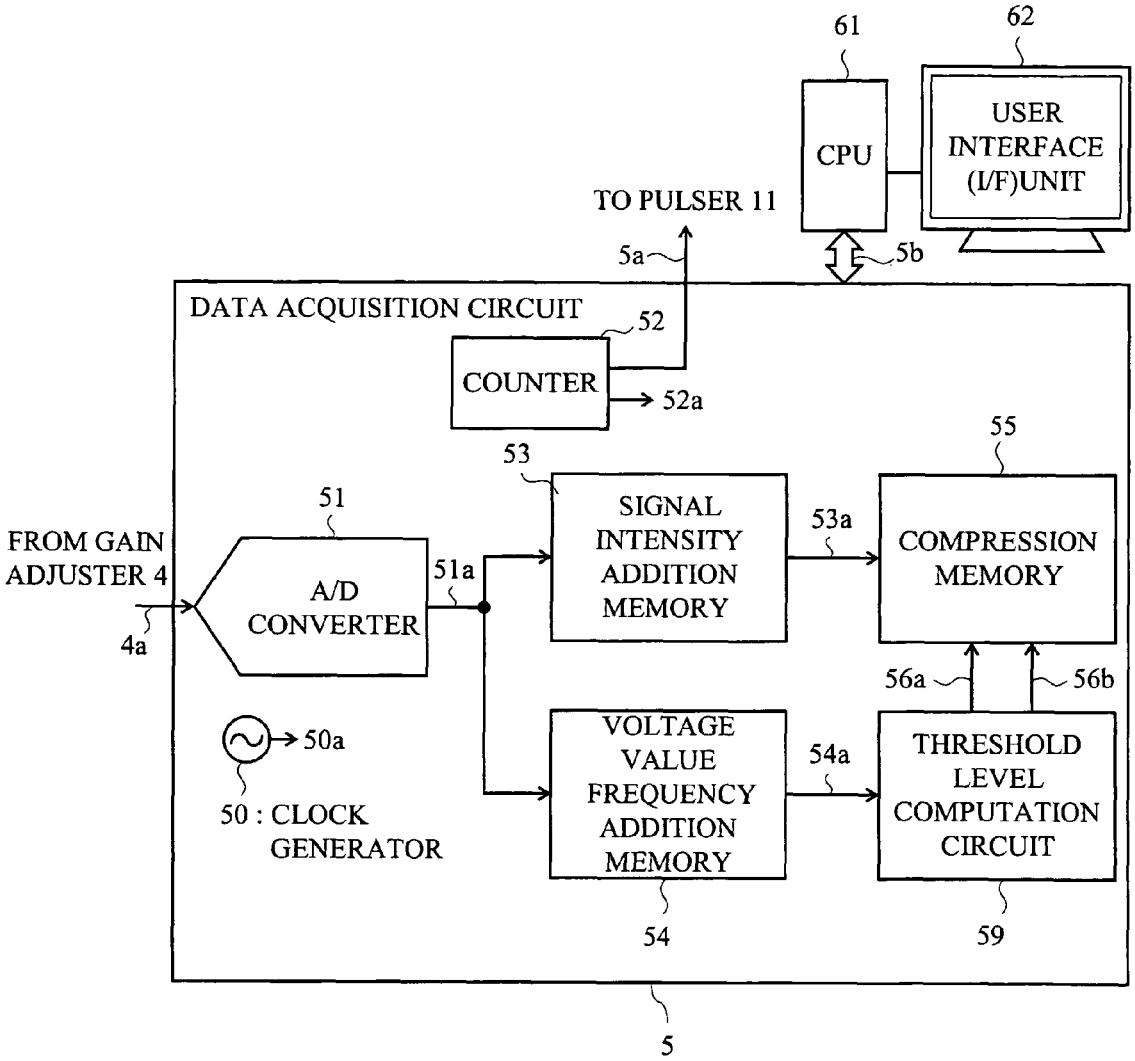
FIG. 5 is a block diagram showing an example of the configuration of a time-of-flight mass spectrometer having a data processing function according to a second embodiment of the present invention.

FIG. 5 is a drawing showing an example of the configuration of a time-of-flight mass spectrometer having a data processing function according to a second embodiment of the present invention. FIG. 5 illustrates a data acquisition circuit 5, a CPU 61, and a user I/F unit 62. With respect to the components not shown in FIG. 5 compared with FIG. 1, components having basically the same functions as those of the components shown in FIG. 1 are connected.

Also, the data acquisition circuit 5 has functions similar to those of the data acquisition circuit shown in FIG. 1 except a compression memory 55-1 and a threshold level computation circuit 59. Although the function of the threshold level computation circuit 59 is almost the same as that of the threshold level computation circuit 56 in the first embodiment, the threshold level computation circuit 59 performs a predetermined process based on the voltage value frequency addition process results 54*a* to calculate a threshold level 59*a* and an offset value, and these signals outputted from the threshold level computation circuit 59 are different from those outputted from the threshold level computation circuit 56. In this embodiment, the threshold level 59*a* and an average value (offset value) 59*b* are outputted.

Figures 6A, 6B, 6C:
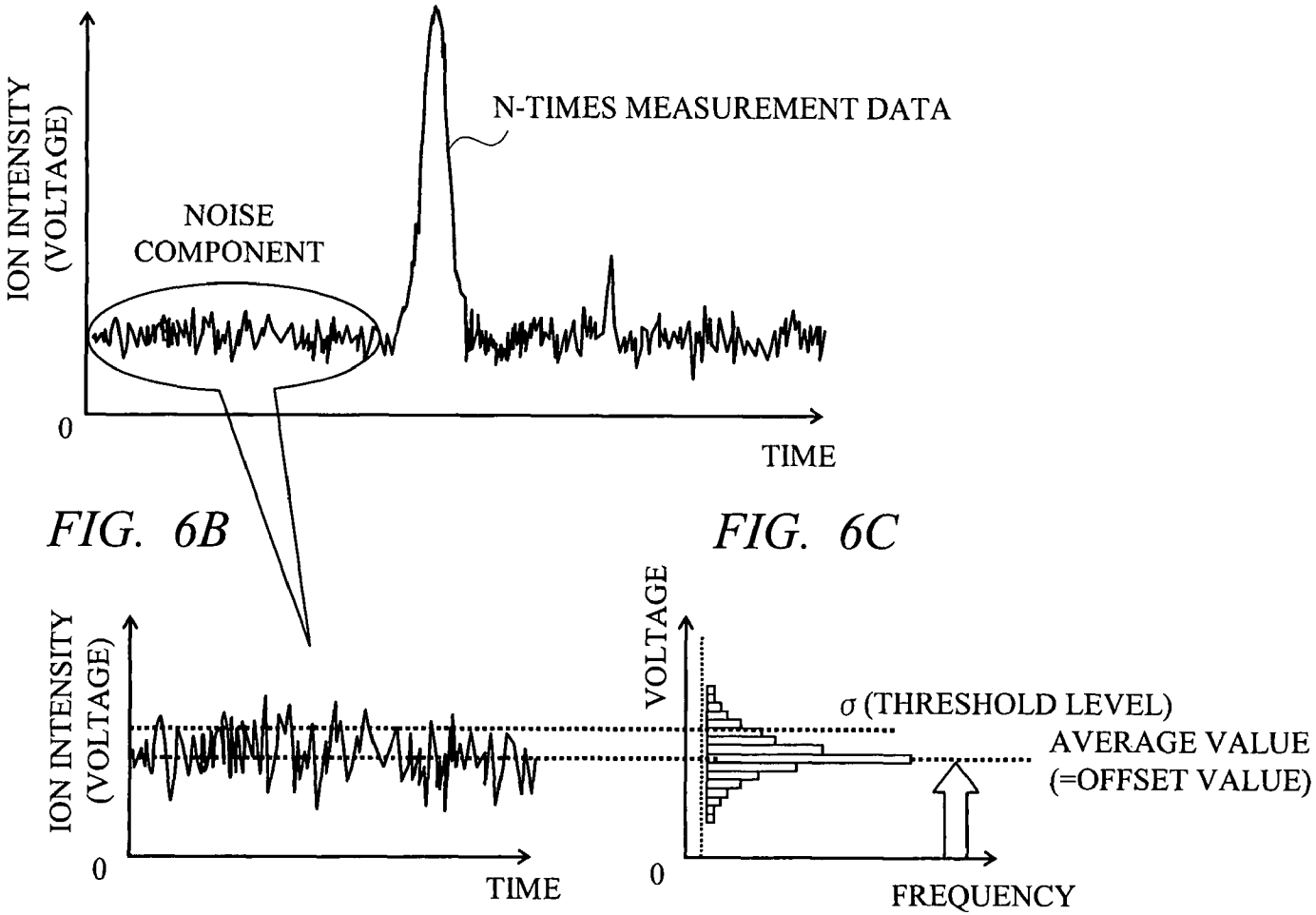
FIG. 6A is a drawing showing an example of storage in a signal intensity addition memory in a data processing method according to the second embodiment of the present invention.
FIG. 6B is a drawing showing an example of storage in a time zone without signal values of FIG. 6A.
FIG. 6C is a drawing showing an example of storage in a voltage value frequency addition memory in the data processing method according to the second embodiment of the present invention.

Next, the operation of the compression memory 55-1 will be described with reference to FIG. 6A to FIG. 6C. FIG. 6A is similar to FIG. 2A, and FIG. 6B illustrates a time zone without signal values of FIG. 6A. Also, FIG. 6C illustrates a frequency for each voltage value similar to FIG. 2B. In this embodiment, an average value (offset value) is calculated from data of noise values without signal values. More specifically, this is the case where the average value of noise values has a certain offset value, and this offset value is also included in the signal values. Therefore, the offset value represents an error with respect to the original signal level (voltage amplitude). In this embodiment, the compression memory 55-1 has a function to extract a voltage value obtained by subtracting this offset value at the time of extracting data.

As a result, in this embodiment, an ion spectrum analysis can be performed with using the values closer to actual voltage values.

Note that, in this embodiment, the offset value 59*b* outputted from the threshold level computation circuit 59 is inputted to the compression memory 55-1. Alternatively, the offset value 59*b* can be inputted to the signal intensity addition memory 53. In this case, a measurement for outputting the offset value is performed before data is stored in the signal intensity addition memory 53. Also, after data is stored in the signal intensity addition memory 53, data may be extracted by using only the threshold level 59*a*.

Third Embodiment

Figure 7:
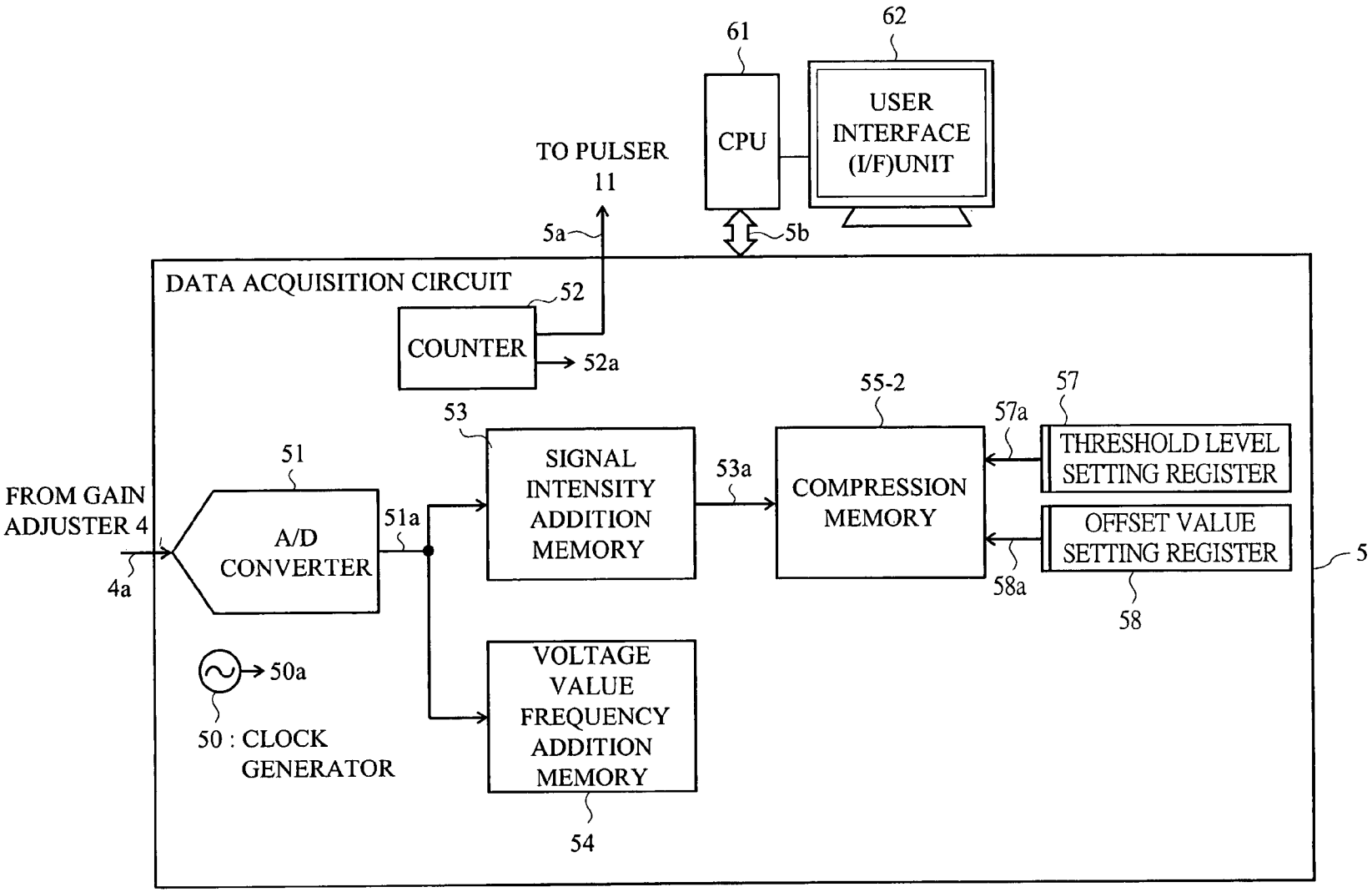
FIG. 7 is a block diagram showing an example of the configuration of a time-of-flight mass spectrometer having a data processing function according to a third embodiment of the present invention.

FIG. 7 is a drawing showing an example of the configuration of a time-of-flight mass spectrometer having a data processing function according to a third embodiment of the present invention. Also in the configuration shown in FIG. 7, only new components will be described. In this embodiment, the case will be described, in which registers which allow an apparatus user to set the threshold level and the offset value described in the second embodiment is provided, and these values are inputted to the compression memory.

First, a normal measurement is performed to store the data in the signal intensity addition memory 53 and the voltage value frequency addition memory 54. Thereafter, the contents of the voltage value frequency addition memory 54 (and the signal intensity addition memory 53) are read by the user via the CPU 61 to determine an offset value and a threshold level based on the histogram results of noise values. Then, these values are set in a threshold level setting register 57 and an offset value setting register 58, respectively, and then, data exceeding the threshold level is extracted by using a compression memory 55-2. This assumes a case where an ion signal and the amount and distribution of noise levels are determined by the apparatus user (or determined through software) to set a desired threshold level and a desired offset value for data acquisition.

As a result, according to this embodiment, the apparatus user can perform a flexible measurement.

Note that the threshold level and the offset value may be used for the decision or as a correction value at the time when data is stored in the signal intensity addition memory 53.

Also, this embodiment can also be applied to a case where only a register that allows the apparatus user to set a threshold level is provided.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention relates to a mass spectrometry technology. More particularly, it is effectively applied to a data processing technology for mass spectrometry using an A/D converter in a time-of-flight mass spectrometer.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A time-of-flight mass spectrometer, comprising:

detecting means for detecting an ion which is ionized from a sample and accelerated to fly;

an A/D converter which samples an analog signal output from the detecting means and converts the sampled analog signal to a digital signal;

a first memory circuit which stores sampling data by adding up said sampling data to a previously stored sampling data;

a second memory circuit which stores peak voltage values and their frequencies of said sampling data output from said A/D converter by adding up said peak voltage values and their frequencies to previously stored peak voltage values and their frequencies;

a computing unit which performs a predetermined process based on a result of the adding in the second memory circuit to calculate a threshold level;

a third memory circuit which extracts data exceeding the threshold level, which is an output signal from said computing unit, from said sampling data added and stored in said first memory circuit, and stores the extracted data; and a CPU which receives the extracted data stored in the third memory circuit and processes the received extracted data, wherein the first memory circuit stores sampling data by adding up ($1^{st}$-(n) th) sampling data one after another, wherein the timing of adding up ($1^{st}$-(n-1) th) peak voltage and their frequencies of the second memory circuit is same as the timing of adding up ($1^{st}$-(n-1) th) sampling data of the first memory circuit, and wherein the computing unit calculates the threshold level based on the result of ($1^{st}$-(n-1) th) addition of the second memory circuit and transmits the threshold level at the timing of the (n) th addition of the first memory circuit.

2. The time-of-flight mass spectrometer according to claim 1 further comprising: counter means which controls data storage, data computation, and data extraction.

3. A time-of-flight mass spectrometer comprising:

detecting means for detecting an ion which is ionized from a sample and accelerated to fly;

an A/D converter which samples an analog signal output from the detecting means and converts the sampled analog signal to a digital signal;

a first memory circuit which stores sampling data by adding up said sampling data to a previously stored sampling data;

a second memory circuit which stores peak voltage values and their frequencies of said sampling data output from said A/D converter by adding up said peak voltage values and their frequencies to a previously stored peak voltage values and their frequencies;

a computing unit which performs a predetermined process based on a result of the adding in the second memory circuit to calculate a threshold level and an offset value;

a third memory circuit which extracts data obtained by performing an adding/subtracting process equivalent to the offset value to data exceeding the threshold level, which is an output signal from said computing unit, from said sampling data added and stored in said first memory circuit, and stores the extracted data; and a CPU which receives the extracted data stored in the third memory circuit and processes the received extracted data, wherein the first memory circuit stores sampling data by adding up ($1^{st}$-(n) th) sampling data one after another, wherein the timing of adding up ($1^{st}$-(n-1) th) peak voltage and their frequencies of the second memory circuit is same as the timing of adding up ($1^{st}$-(n-1) th) sampling data of the first memory circuit, and wherein the computing unit calculates the threshold level based on the result of ($1^{st}$-(n-1) th) addition of the second memory circuit and transmits the threshold level at the timing of the (n) th addition of the first memory circuit.

4. The time-of-flight mass spectrometer according to claim 3 further comprising: counter means which controls data storage, data computation, and data extraction.

5. A method for time-of-flight mass spectrometry, comprising the steps of:

detecting an ion which is ionized from a sample and accelerated to fly;

sampling the detected signal by an A/D converter;

storing sampling data from the A/D converter in a first memory circuit by adding up said sampling data to a previously stored sampling data;

performing, simultaneously with the adding process of the sampling data, an addition process of peak voltage values and their frequencies of said sampling data output from said A/D converter by adding up said peak voltage values and their frequencies to previously stored peak voltage values and their frequencies, and storing a result of the addition process in a second memory circuit;

calculating a threshold level by using the result of the addition process of the frequencies of voltage values in the second memory circuit;

extracting data exceeding the threshold level by using said calculated threshold level from the sampling data in said first memory circuit, and storing the extracted data in a third memory circuit; and receiving the extracted data stored in the third memory circuit and processing the received extracted data with a CPU, wherein the timing of adding up ($1^{st}$-(n-1) th) peak voltage and their frequencies of the second memory circuit is same as the timing of adding up ($1^{st}$-n-1) th) sampling data of the first memory circuit, and wherein the step of calculating, calculating the threshold level based on the result of ($1^{st}$-(n-1) th) addition of the second memory circuit and transmits the threshold level at the timing of the (n) th addition of the first memory circuit.

6. A method for time-of-flight mass spectrometry, comprising the steps of:

detecting an ion which is ionized from a sample and accelerated to fly;

sampling the detected signal by an A/D converter;

storing sampling data from the A/D converter in a first memory circuit by adding up said sampling data to a previously stored sampling data;

performing, simultaneously with the adding process of the sampling data, an addition process of peak voltage values and their frequencies of said sampling data output from said A/D converter by adding up said peak voltage values and their frequencies to previously stored peak voltage values and their frequencies, and storing a result of the addition process in a second memory circuit;

calculating a threshold level and an offset value by using the result of the addition process of the frequencies of the voltage values in the second memory circuit;

extracting data obtained by performing an adding/subtracting process equivalent to the offset value to data exceeding the threshold level by using said calculated threshold level from an addition process result of the sampling data in said first memory circuit, and storing the extracted data in a third memory circuit; and receiving the extracted data stored in the third memory circuit and processing the received extracted data with a CPU, wherein the timing of adding up ($1^{st}$-(n-1) th) peak voltage and their frequencies of the second memory circuit is same as the timing of adding up ($1^{st}$-(n-1) th) sampling data of the first memory circuit, and wherein the step of the calculating, calculating the threshold level based on the result of ($1^{st}$-(n-1) th) addition of the second memory circuit and transmits the threshold level at the timing of the (n) th addition of the first memory circuit.

* * * * *